US005166460A

United States Patent [19]

Sink

[11] Patent Number: 5,166,460

[45] Date of Patent: Nov. 24, 1992

[54] ORGAN STOP ACTION VALVE MECHANISM

[76] Inventor: James W. Sink, 134 Crepe Myrtle Cir., Winston-Salem, N.C. 27106

[21] Appl. No.: 678,106

[22] Filed: Apr. 1, 1991

[51] Int. Cl.[5] ..... G10B 3/10

[52] U.S. Cl. ..... 84/85; 84/333; 84/343; 84/369

[58] Field of Search ..... 84/85, 333, 334, 343, 84/369

[56] References Cited

U.S. PATENT DOCUMENTS

| | | | |
|---|---|---|---|
| 83,241 | 10/1868 | Baumgarten | 84/333 |
| 598,311 | 2/1898 | Anderson | 84/333 |
| 1,692,507 | 11/1928 | Lamontagne | 84/333 |
| 3,598,894 | 8/1971 | Michel | 84/343 |

OTHER PUBLICATIONS

*The Organ-Builder* 1977; ©1906, plates 34, 35, 37.

*Primary Examiner*—Michael L. Gellner
*Assistant Examiner*—Cassandra Spyrou

[57] ABSTRACT

An organ stop action valve mechanism is presented for controlling pipe or voice actuation with a pivotable control valve member which operates to depress a spring-loaded valve plunger. The control member pivots in an arcuate fashion either to close or to allow the valve to open. The valve is slidably positioned on a pair of guide pins and includes a leather cover to insure proper closing.

19 Claims, 5 Drawing Sheets

ORGAN STOP ACTION VALVE MECHANISM

BACKGROUND OF THE INVENTION

1. Field Of The Invention

The present invention pertains to a stop action valve mechanism for a musical instrument and particularly for a pipe organ.

2. Description Of The Prior Art And Objectives Of The Invention

Pipe organs for use in churches, cathedrals and other large spacious buildings have been in existence for over five hundred years. Pipe organs use stop actions to control the flow of air to the pipes so that the various ranks of pipes can be played or not played individually or in combination. Conventional wind-chest stop actions employing small pallet valves and springs have been long available and are commonly referred to as "spring chests". Another type of stop action mechanism has long employed a slide or wooden strip and is referred to as a "slider". Due to the complications involved in operating and maintaining the spring chests, these types of stop actions have not been in extensive use in several hundred years. However, the slider types are generally used on "tracker" type organs which are built today. Such organs incorporate wind-chests which utilize a series of air channels, one for each note of the keyboard. On top of the grid formed by the air channels is a flat surface referred to as a "table". Sliders are positioned above the table and thereabove is a toeboard upon which rests the organ pipes. One slider is available for each rank of pipes or voice, which may consists of sixty-one pipes. Each wind-chest may contain one to twenty ranks. There is an aperture in the table, the slider and the toeboard which, when aligned, allows air to enter the pipe for sound production.

In conventional organs making a "voice" or rank of pipes playable from two or more keyboards using a "slider" has been impractical, cumbersome and costly. Two air channels must be placed under each pipe, one for each keyboard and there must be two sliders for each rank of pipes, i.e., one to control the air for each of the air channels. Also, a special toeboard with complex channeling is required along with back pressure valves so that the air cannot bleed from one air channel to the other when a particular note is played. Thus, tracker organs today generally have a complete rank or set of pipes for each individual voice on each keyboard and each keyboard requires its own separate wind-chest to play said voices.

Around the turn of the twentieth century organ builders began using electric actions in various forms to control the air entering the pipes. These actions allowed use of a series of switches whereby a single rank of pipes could easily and inexpensively be placed on all keyboards and at different pitches. Organ builders could then take a small number of pipes and make them playable from different keyboards and provide a pipe organ for smaller churches with the advantages of a much larger instrument, at a fraction of the cost. Such electrical actions, while providing versatility and saving initial expense, had one prominent problem. The electrical actions had to be completely rebuilt every twenty years or so at a substantial cost. Routine maintenance has also been a problem with electric control actions. On the other hand, tracker organs generally never have to be rebuilt with only minor maintenance required to keep them in operation for seventy-five to one hundred years.

Thus, with the disadvantages and problems associated with conventional organ mechanisms known, the present invention was conceived and one of its objectives is to provide an organ stop action valve mechanism which is relatively simple in construction, versatile in use and requires little if any maintenance.

Another objective of the present invention is to provide an organ stop action valve mechanism which is easy to maintain like a tracker organ and which provides the versatility of an electric action type organ, i.e., allows different voices or ranks to be played from more than one keyboard.

It is yet another objective of the present invention to provide an organ stop action valve mechanism which utilizes a small planar valve which is slidably mounted on guide pins which closes an aperture over the air channel and includes a resiliently mounted plunger and pivotable valve control member.

Another objective of the present invention is to provide an organ stop action valve mechanism which allows back air pressure to be applied to nearby closed valves preventing air from entering corresponding air channels when one or more valves are opened during playing.

It is still another objective of the present invention to provide an organ stop action valve control member which is hingedly joined to the wind-chest.

Various other objectives and advantages of the present invention become apparent to those skilled in the art as a more detailed explanation is presented below.

SUMMARY OF THE INVENTION

The aforesaid and other objectives are realized by providing a valve mechanism for an organ which includes a plurality of valves each mounted over a separate air channel aperture. A valve plunger is slidably mounted within the toeboard of the wind-chest for contacting each valve. An elongated valve control member is pivotable in an arcuate fashion over a set of valve plungers to thereby depress the plungers from a first position and to release the plungers thereby allowing the valves to open, as the control member pivots to a second position. A resilient coil spring is positioned between the control member and toeboard which encloses the plunger. A pair of double hinges mounted on each side of the wind channel connect to the elongated valve control member and allow it to pivot in an arcuate fashion from a first to a second position.

DESCRIPTION OF THE PREFERRED EMBODIMENT

Figure 2:
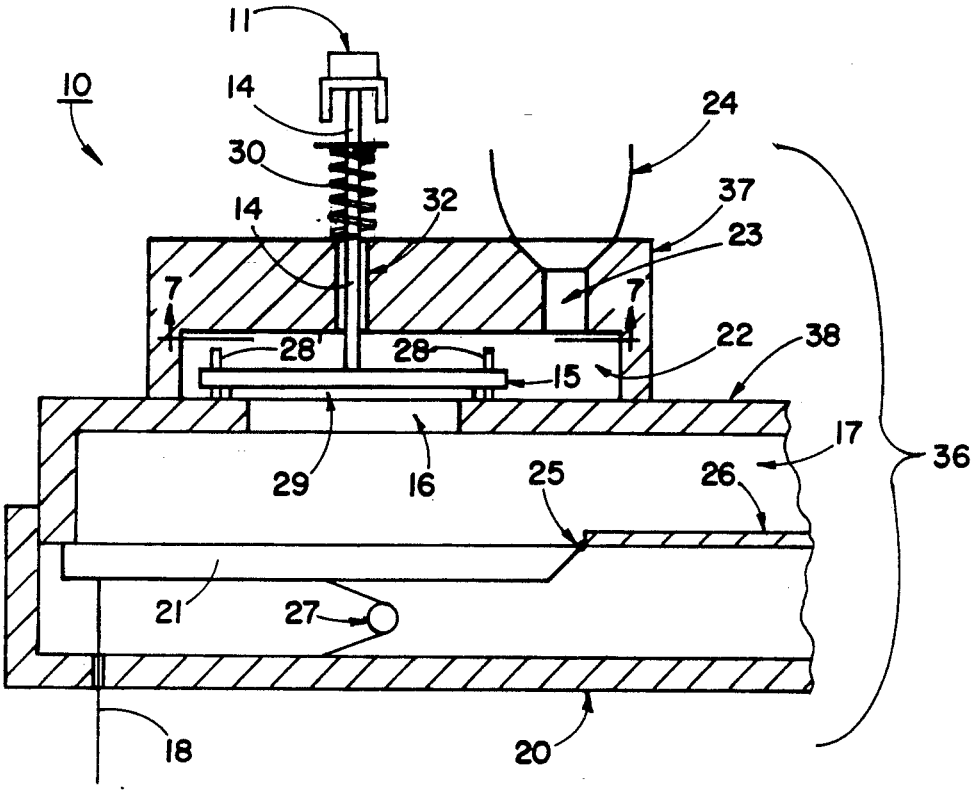
FIG. 2 shows a cross-sectional view of the invention somewhat as shown in FIG. 1.
Figure 5:
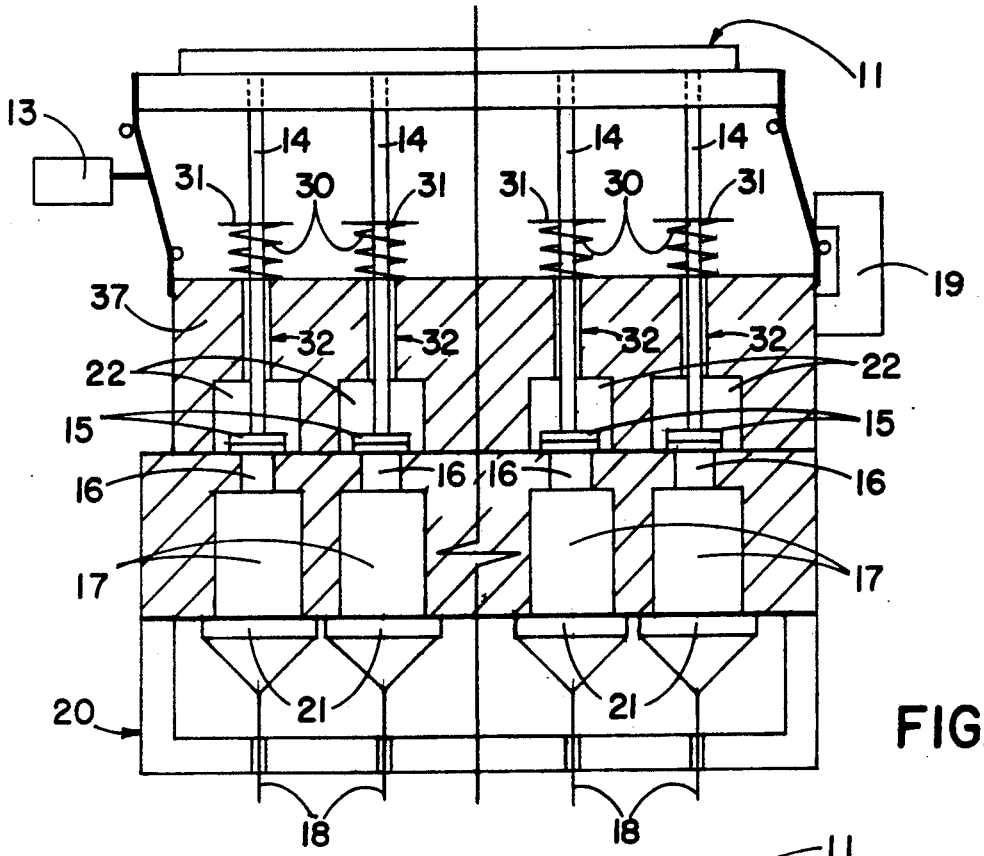
FIG. 5 depicts in cross-sectional view, a plurality of valve mechanisms with the valve closed in accordance with the pivoted control member.
Figure 6:
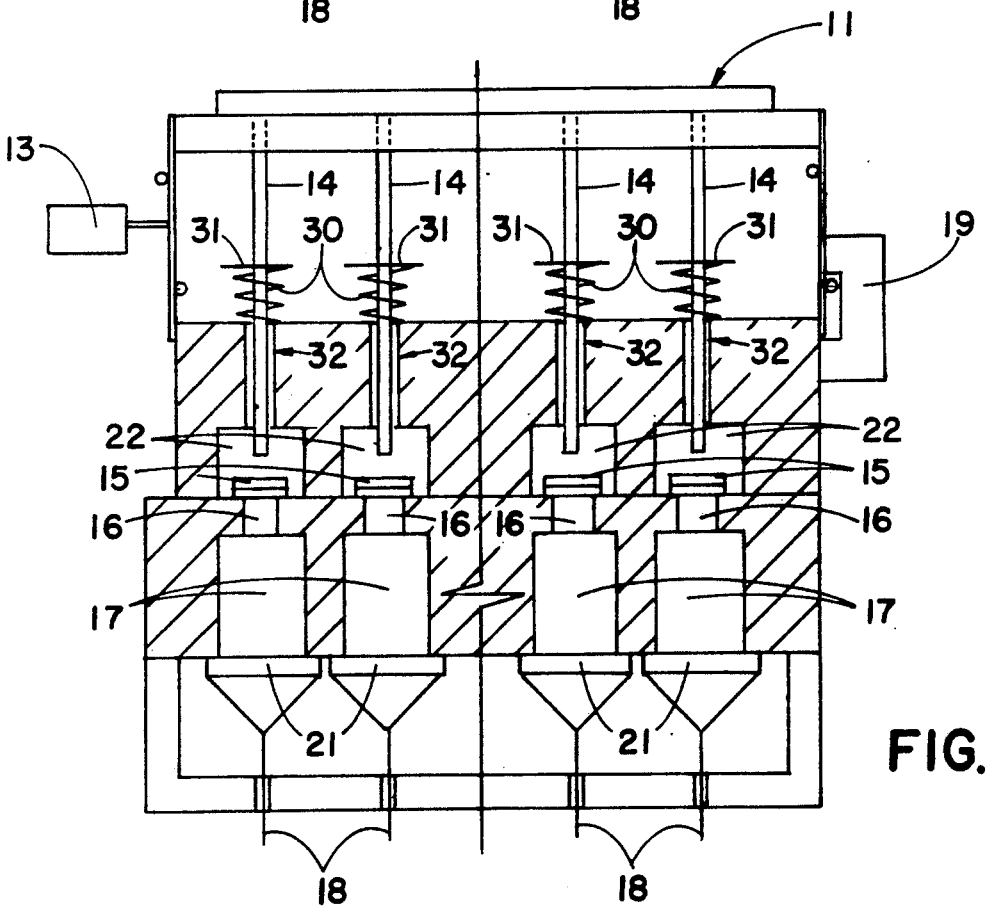
FIG. 6 presents a cross-sectional view of the valve mechanism of the present invention with the plunger in a raised posture to allow the valve to open.
Figure 7:
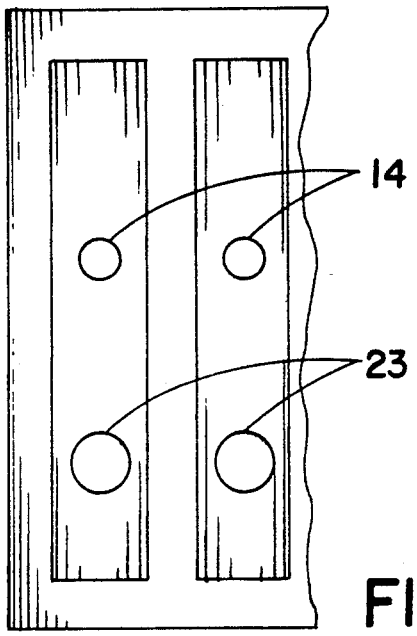
FIG. 7 shows a bottom view of a plurality of air chambers within the toeboard as seen along lines 7—7 of FIG. 2.

The preferred form of the stop action valve mechanism of the invention is illustrated in FIGS. 2, 5, and 6 whereby an elongated control member is pivotably mounted to extend above the toeboard. The toeboard comprises a series of apertures for slidably receiving a valve plunger and a series of holes for communicating with the organ pipes. The elongated valve control member, by pivoting from a first to a second position applies downward pressure to the plunger to thereby maintain the floating planar valve in a closed posture by gravity. A solenoid assembly drives the elongated control member in an arcuate path above the toeboard for depressing a valve plunger. A leather strip is attached to the bottom of the valve for tightly covering the aperture within the air channel and the valve is slidably mounted on a pair of vertical guide pins proximate said channel apertures. An electric solenoid drives the pivotable control member, thus allowing the weight of the pivotable control member to rest upon the valve and press the plunger against the valve to prevent it from opening.

DETAILED DESCRIPTION OF THE DRAWINGS AND OPERATION OF THE INVENTION

Figure 1:
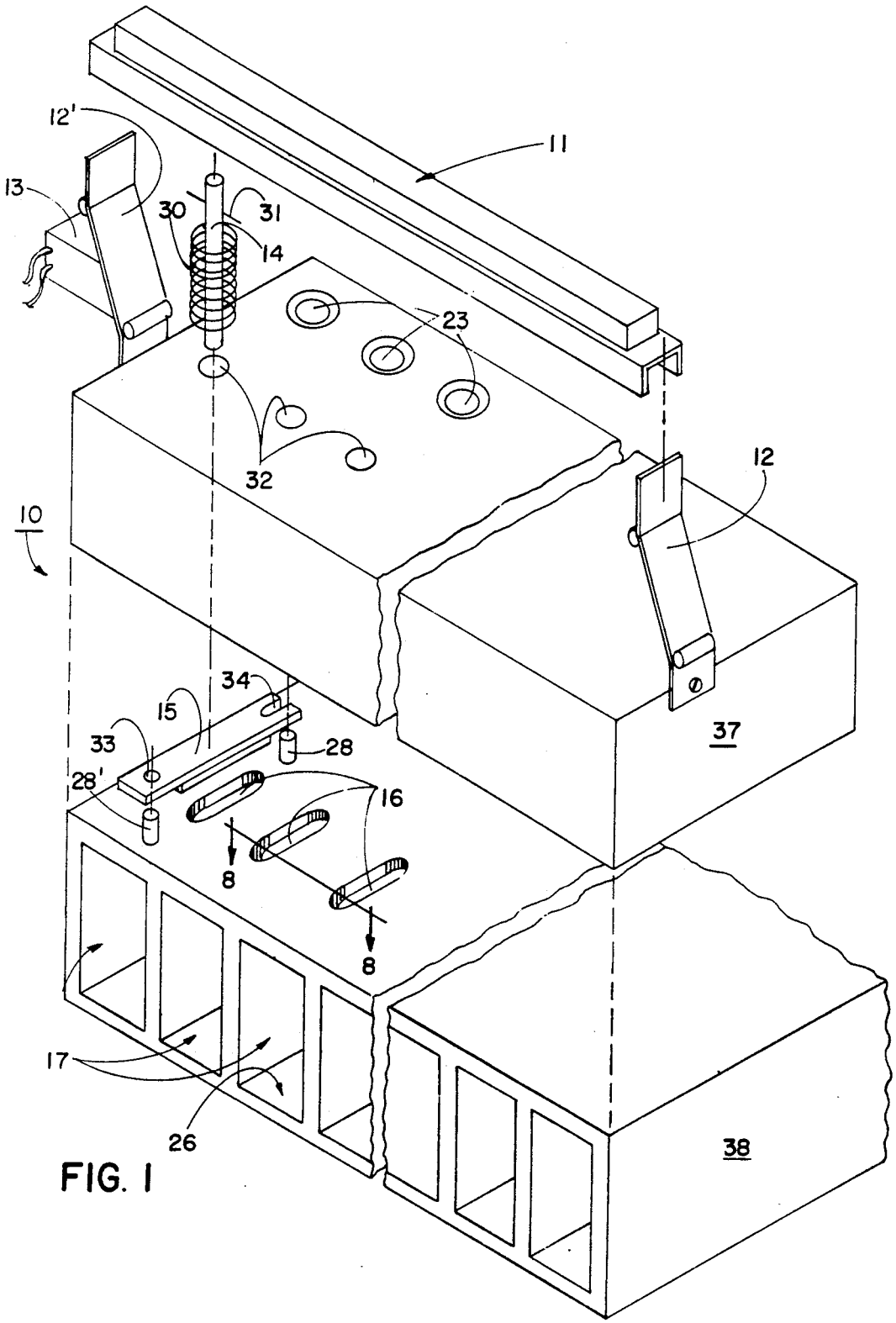
FIG. 1 pictures a wind-chest with the valve mechanism of the present invention thereon in exploded fashion.

Turning now to the drawings, organ stop action valve mechanism 10 is shown in FIG. 1 having valve control member 11 pivotably attached to double hinges 12, 12' and wind-chest 36 (FIG. 2). Solenoid 13 (FIG. 1) is positioned proximate hinge 12' and is electrically operated. As would be understood, as valve control member 11 moves from a first position as seen in FIG. 5 to a second position as shown in FIG. 6, cylindrical plungers 14 are withdrawn from valve 15 thereby allowing valve 15 to open as air moves from aperture 16 of air channel 17. Hinge stop 19 indirectly terminates the movement of control member 11 as shown in FIG. 6. As would be further understood, wires 18 as seen in FIGS. 5 and 6 are joined to keyboards, pedals or the like (not shown) and when said keys or pedals are depressed pallet valve 21 is opened allowing air to enter air channel 17 for movement through air channel apertures 16 as required.

By depressing a particular key or pedal (not shown) during playing, wire 18 opens pallet valve 21 allowing air to flow from pallet box 20 as seen in FIGS. 5 and 6, past pallet valves 21, through channel aperture 16, past valve 15 and into toeboard cavity 22, as better shown in FIG. 2. Air entering toeboard cavity 22 moves through toeboard aperture 23 and into pipe 24 for the creation of a particular tone. Pallet valve 21 as seen in FIG. 2 is swingably connected to air channel floor 26 at point 25 and valve 21 remains closed by pressure generated by spring 27.

Figure 4A:
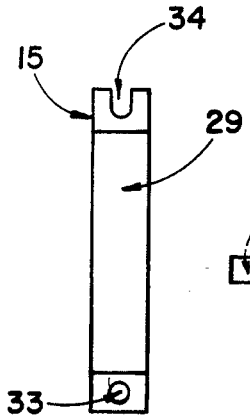
FIGS. 4A and 4B illustrate respectively a bottom and side view of the planar valve of the invention.
Figure 4B:
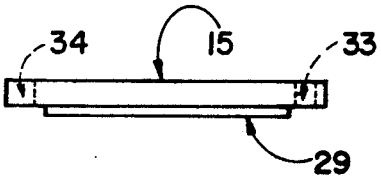
Figure 3:
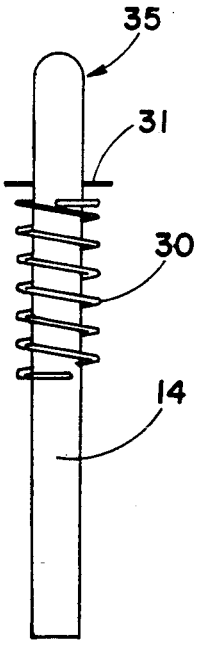
FIG. 3 demonstrates the valve plunger and spring.

Valve 15 is slidably positioned within toeboard cavity 22 and is mounted on guide pins 28, 28' through guide pin slot 34 and guide pin hole 33 respectively. In order to insure a tight fit, valve 15 has a bottom covering 29 of leather as shown in more detail in FIGS. 4A and 4B. Plunger 14 is spring-loaded by coil spring 30 as seen in FIG. 3 and includes spring stop 31. As seen in FIGS. 5 and 6, spring stop 31 compresses spring 30 when control member 11 is in a "closed" posture (FIG. 5), whereupon control member 11 releases spring stop 31 from coil spring 30 as control member 11 moves to a second or "open" posture (FIG. 6). Plunger apertures 32 provide access through toeboard 37 to valve 15 and allows very little air to escape therethrough. Pipe apertures 23 are also positioned through toeboard 37 as seen more clearly in FIG. 1. Toeboard 37, air channel housing 38 and pallet box 20 comprise wind-chest 36 (FIG. 2).

Valve control member 11 moves in an arcuate path from a substantially upright or second open position as shown in FIG. 6 to a closed or downward first position as shown in FIG. 5. Stop member 19 which is joined to toeboard 37 terminates the arcuate action of valve control member 11. As seen in FIG. 2, control member 11 has an open channel configuration and slidably engages rounded end 35 of cylindrical plunger 14 as shown in FIG. 3, thereby reducing friction and prolonging the durability of plunger 14.

Figure 8:
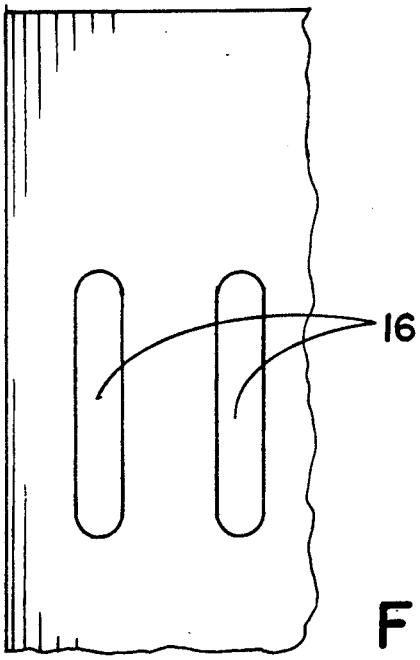
FIG. 8 demonstrates a top view from above the table to the air channels as shown along lines 8—8 in FIG. 1.
Figure 9:
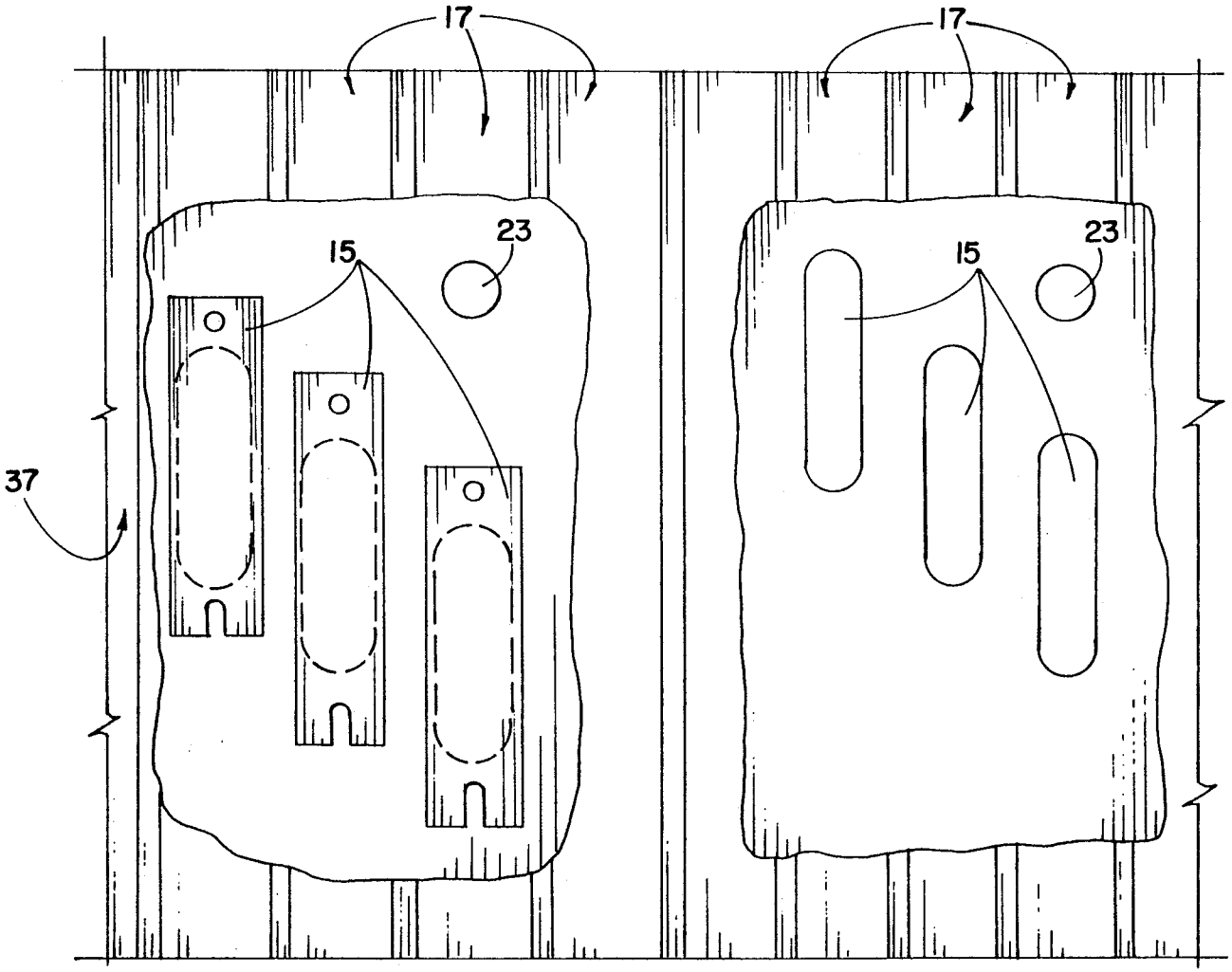
FIG. 9 provides a cut-away top view of a section of the toeboard.

In FIG. 8, a bottom view along lines 8—8 of FIG. 1 illustrates the close proximity of air channel apertures 16. In FIG. 9 a partial section of toeboard 37 is shown in a top view. As seen therein, toeboard apertures 23 and pipes 24 (not shown) can be operated by any of three separate valves 15 from supply air entering by air channel 17 thereunder. Thus, a pipe 24 (not shown) mounted in aperture 23 may be sounded by either of valves 15 opening. Accordingly, if one of said valves 15 opens, the other two, due to the pressure generated by open valve 15 would be held in a closed posture by the back pressure generated. Thus, multiple valve actions can be provided in a convenient and inexpensive fashion with the durability of conventional "slider" organs, but without the associated problems and expense.

The illustrations and examples provided herein are for explanatory purposes and are not intended to limit the scope of the appended claims.

I claim:

1. An organ stop action valve mechanism for controlling air flow through an aperture in a channel housing comprising: a free floating valve, said valve movable to close said aperture, a valve control member, said control member joined to said channel housing and pivotable from a first to a second position, a valve plunger, said plunger slidably mounted between said valve control member and said valve, means to pivot said control member, said pivot means contacting said control member whereby said valve control member pivoting to said first position forces said plunger against said valve to close said aperture and pivoting to said second position releases said plunger from said valve to allow said aperture to open.

2. An organ stop action valve mechanism as claimed in claim 1 wherein said valve comprises a floating member.

3. An organ stop action valve mechanism as claimed in claim 1 wherein said valve comprises a planar member.

4. An organ stop action valve mechanism as claimed in claim 1 and including means to guide said free floating valve, said valve guide means comprising a guide pin, said guide pin mounted on said channel housing proximate said aperture.

5. An organ stop action valve mechanism as claimed in claim 1 wherein said valve plunger comprises a cylindrical member.

6. An organ stop action valve mechanism as claimed in claim 1 wherein said valve plunger is resiliently mounted between said valve control member and said valve.

7. An organ stop action valve mechanism as claimed in claim 1 wherein said pivot means comprises a solenoid.

8. An organ stop action valve mechanism as claimed in claim 1 and including a toe board, said toe board positioned between said valve and said valve control member.

9. An organ stop action valve mechanism as claimed in claim 4 wherein said valve guide means comprises a pair of valve guide pins, said pins positioned on said housing proximate said aperture, with said valve mounted on said pins.

10. An organ stop action valve mechanism as claimed in claim 1 and including a plurality of valves, said channel housing defining a plurality of apertures, each of said valves positioned over one of each of said plurality of apertures.

11. An organ stop action valve mechanism as claimed in claim 1 wherein said channel housing comprises a plurality of air channels.

12. An organ stop action valve mechanism as claimed in claim 8 wherein said toe board defines a series of pipe openings.

13. An organ stop action valve mechanism as claimed in claim 1 wherein said control member pivots in an arcuate path.

14. An organ stop action valve mechanism for controlling air flow through an aperture in a channel housing comprising: a free floating valve, said valve slidably positioned over said channel housing aperture, means to guide said free floating valve, said guide means positioned within said channel housing proximate said aperture, a valve control member, said valve control member for controlling said valve, a toe board, said control member hingedly joined to said toe board, said toe board positioned atop said channel housing, said control member pivotable from a first to a second position, a valve plunger, said plunger slidably mounted within said toe board and contiguous with said control member whereby pivoting said control member to said first position forces said plunger by gravity to close said free floating valve against said channel housing aperture and said control member allows said valve to open when said control member pivots to said second position.

15. An organ stop action valve mechanism as claimed in claim 14 wherein said plunger is resiliently mounted.

16. An organ stop action valve mechanism as claimed in claim 14 and including means to pivot said valve control member, said pivot means connected to said valve control member.

17. An organ stop action valve mechanism as claimed in claim 16 wherein said pivot means comprises a solenoid.

18. An organ stop action valve mechanism as claimed in claim 14 and including a plurality of valves, a plurality of valve control members, said valve control members each for controlling one of said plurality of valves.

19. An organ stop action valve mechanism as claimed in claim 14 wherein said toe board defines a plurality of pipe openings, each of said pipe openings associated with a plurality of channel housing apertures.

* * * * *